US006202949B1

(12) United States Patent
Hayles, Jr.

(10) Patent No.: US 6,202,949 B1
(45) Date of Patent: Mar. 20, 2001

(54) PULVERIZER ASSEMBLY

(76) Inventor: Peter E. Hayles, Jr., 225 Groves Rd., Toms River, NJ (US) 08753

( * ) Notice: Subject to any disclaimer, the term of this patent is extended or adjusted under 35 U.S.C. 154(b) by 0 days.

(21) Appl. No.: 09/383,595

(22) Filed: Aug. 26, 1999

(51) Int. Cl.[7] ..... B02C 13/28
(52) U.S. Cl. ..... 241/188.1; 241/284; 241/295
(58) Field of Search ..... 241/284, 46.11, 241/294, 295, 300, 526, 190, 197, 275, 188.1, 187

(56) References Cited

U.S. PATENT DOCUMENTS 5,188,303 * 2/1993 Hoof ..... 241/300
5,400,977 * 3/1995 Hayles ..... 241/190

* cited by examiner

*Primary Examiner*—Mark Rosenbaum
(74) *Attorney, Agent, or Firm*—Clifford G. Frayne

(57) ABSTRACT

There is disclosed a pulverizing assembly having paired interconnecting cylindrical chambers wherein each chamber is provided with a rotatable shaft having a plurality of discs mounted thereon and wherein each disc is provided with a plurality of arcuately-shaped shoe members mounted in abutting relationship about the periphery of each disc member to facilitate the stage wise circulation of a slurry introduced into the assembly and to induce particle collision of the solids contained in the slurry so as to reduce the size of the particulate solids before exiting the assembly.

12 Claims, 3 Drawing Sheets

PULVERIZER ASSEMBLY

BACKGROUND OF THE INVENTION

1. Field of the Invention

The present invention is related to a pulverizer assembly, and more particularly to a pulverizer assembly having the capability of receiving materials in a slurry condition, such as drill cuttings from a wellbore and to significantly reduce the particle size of particulate material included in the slurry.

2. Description of the Prior Art

The disposal of drill cuttings has been a longstanding problem in the field of well drilling and this problem has recently received attention due to increased concern regarding the environment. Offshore drilling operations, in particular, are problematic because the transport of the cuttings to a landfill or a shore-based processing system is required.

One solution to this problem is disclosed in U.S. Pat. Nos. 5,109,933 and 5,129,469. The prior art system for disposing of drill cuttings as described in these patents involves the mixing and cuttings with a carrier liquid such as water, and reducing the size of the cuttings in a pump having an impeller of a backward swept blade type to form a slurry of the particles and the carrier liquid for injection into a well for disposal. Other types of pulverizers and material breaking machinery are described, for example, in the following U.S. Pat. Nos. 310,940 to Gould; 315,064 to Pratt; 345,408 to Birge; 359,630 to Pratt; 666,404 to Wurster; 2,049,920 to McNitt; 3,927,840 to Nash; 3,931,936 to Petry; and 4,947,906 to Schroeder.

In U.S. Pat. No. 5,400,977 to Applicant of the present invention there is disclosed a design of a pulverizer having pivotally mounted blade members; however there remains continuing requirements for assemblies to provide improved rates of pulverization of material with minimal down time for servicing equipment.

SUMMARY OF THE INVENTION

These and other objects of the present invention are achieved in a pulverizing assembly comprised of a tank having a chamber for rotatably mounted shaft members having a plurality of disc members about which are mounted a plurality of arcuately-shaped shoe members formed with lateral outwardly-extending curvilinearly-shaped vanes for accelerating a slurry of particulate material being processed within the chamber as more fully hereinafter disclosed.

OBJECTS OF THE INVENTION

It is an object of the present invention to provide for an improved apparatus and process for pulverizing particulate solid materials.

It is another object of the present invention to provide for an improved pulverizer for use in a drill cutting disposal system wherein one pass of the cuttings through the pulverizer is sufficient to reduce the cuttings to appropriate size.

It is a still further object of the present invention to provide an improved pulverizer for use in pulverizing various materials, such as drill cuttings, agricultural products and various types of minerals with reduced downtimes and turnarounds.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein.

DETAILED DESCRIPTION OF THE DRAWINGS

Figure 1:
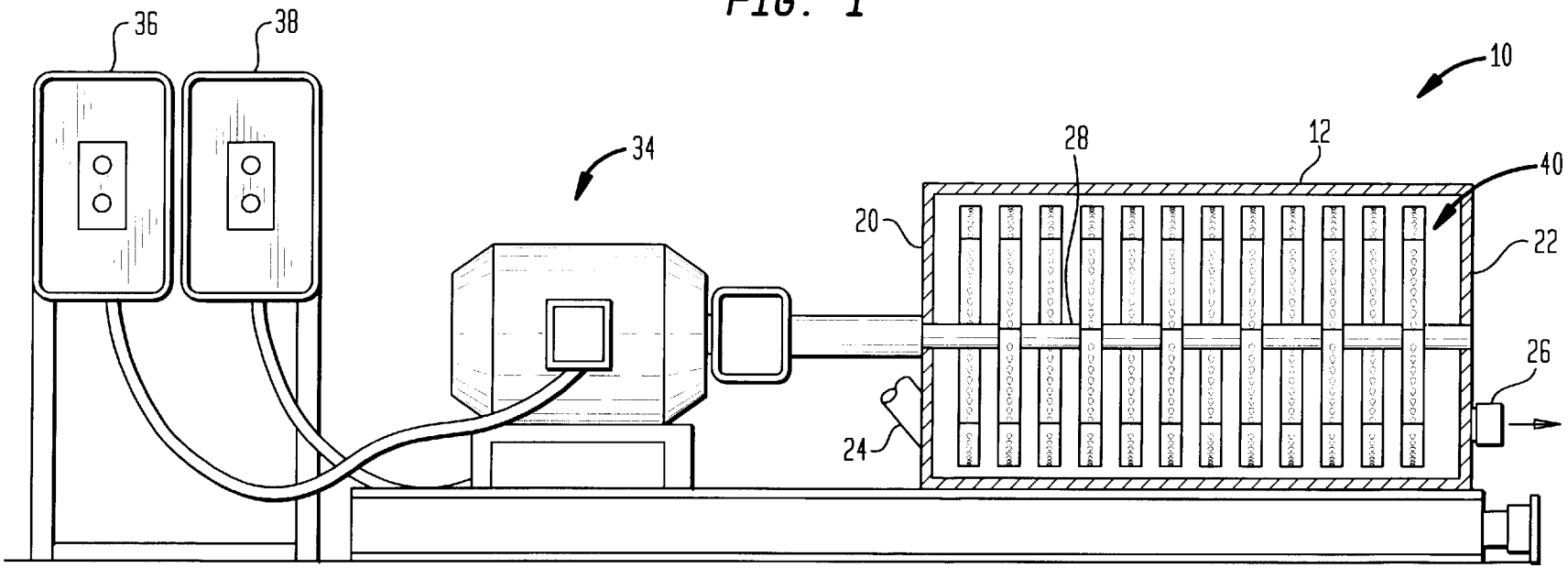
FIG. 1 is an elevational view, partially in section, of the pulverizer assembly of the present invention.
Figure 3:
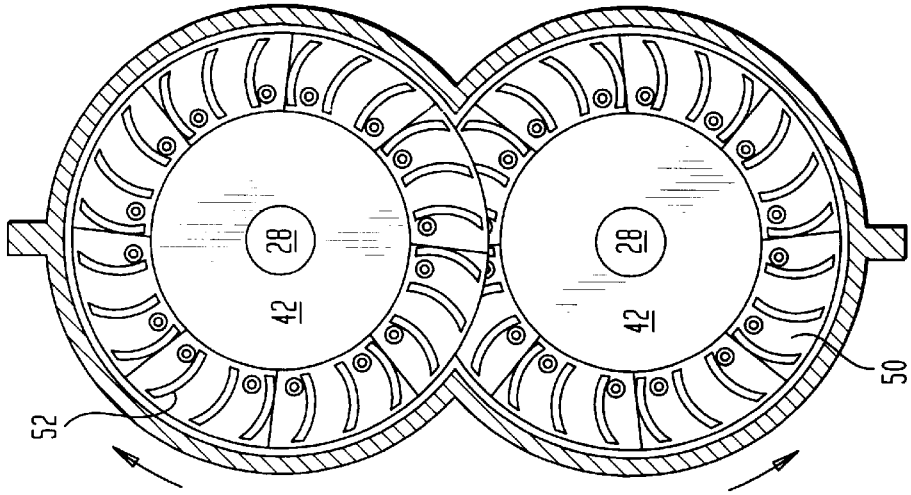
FIG. 3 is a sectional side view taken along the lines 3—3 of FIG. 2.
Figure 2:
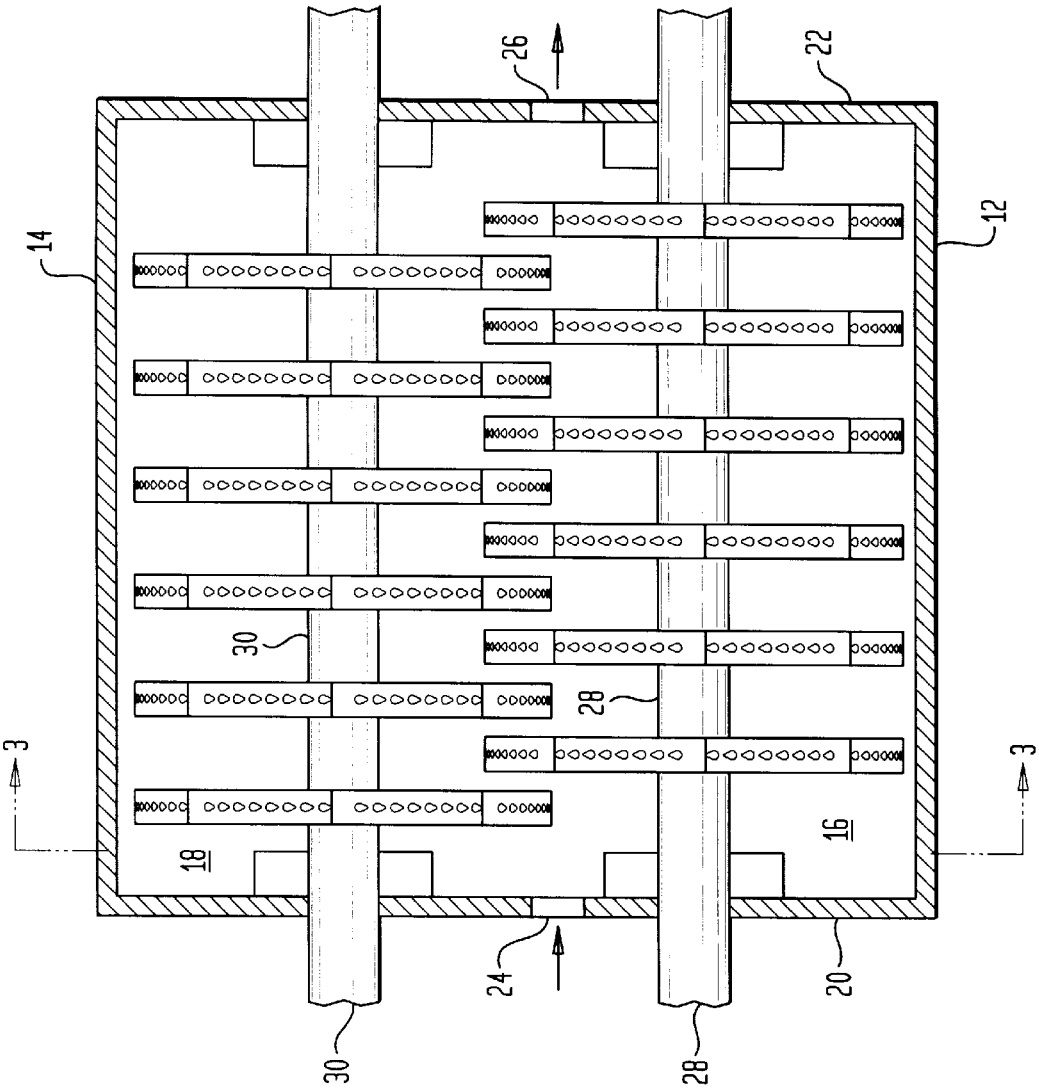
FIG. 2 is a sectional top plan view of the interior of the tank of the pulverizer assembly of the present invention.
Figure 4:
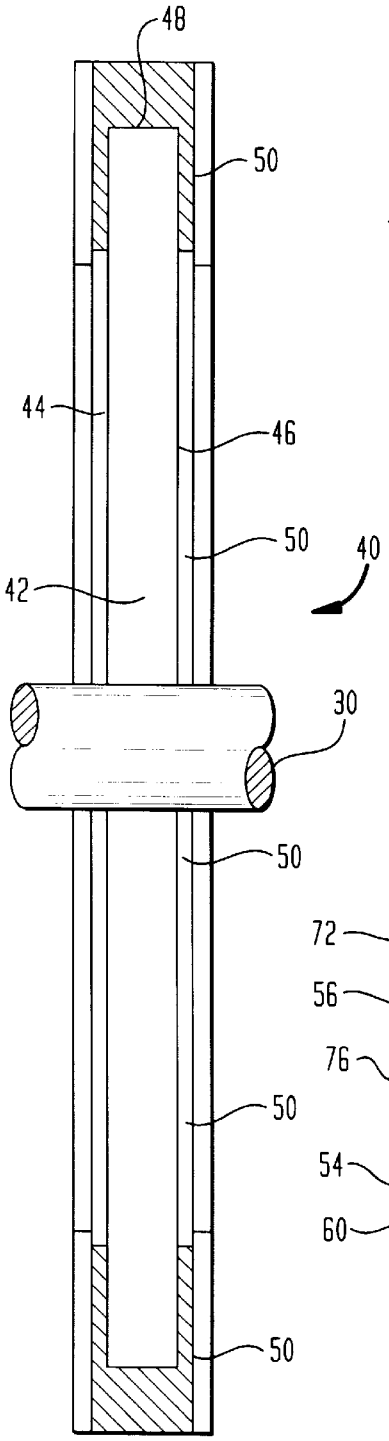
FIG. 4 is an enlarged sectional side view of a disc member taken along the lines 4—4 of FIG. 3.
Figure 5:
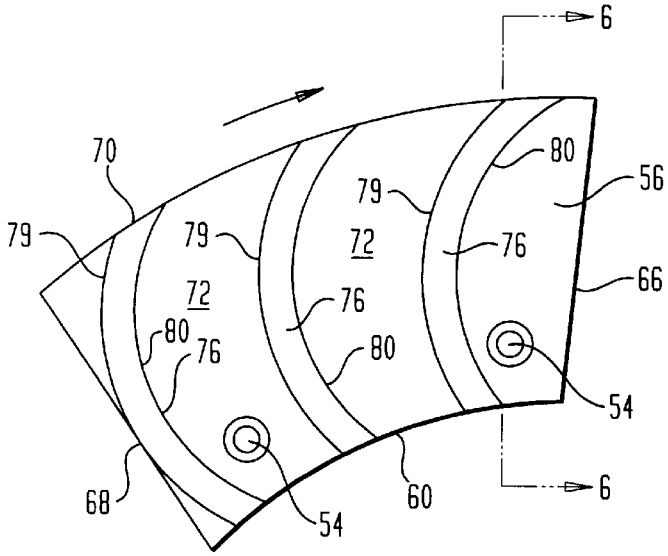
FIG. 5 is an enlarged elevational view of a shoe member.
Figure 6:
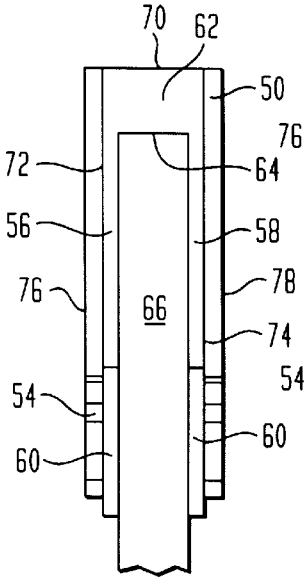
FIG. 6 is a right side view of the shoe member of FIG. 4.
Figure 7:
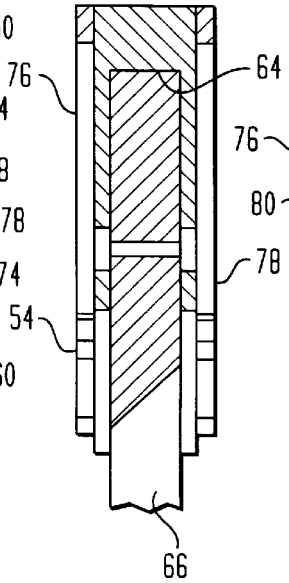
FIG. 7 is a cross-sectional side view of the shoe member as mounted on a disc member.
Figure 8:
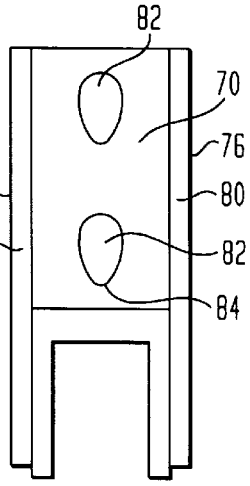
FIG. 8 is a left side view of the shoe member of FIG. 4.

Referring now to the drawings, and particularly FIGS. 1 and 3, there is illustrated a pulverizer assembly of the present invention, generally indicated as 10, comprised of overlapping cylindrical tank portions 12 and 14 in a figure eight configuration in section defining chamber portions 16 and 18 and enclosed by end walls 20 and 22 having an inlet and an outlet conduit 24 and 26, respectively. In each tank portion 12 and 14, there is mounted for rotation a shaft 28 and 30, respectively, extending in parallelled relationship throughout the length of the tank portions 12 and 14. Each shaft is driven for rotation by a respective motor assembly, generally indicated as 34, under the control of respective control breaker panels 36 and 38.

A plurality of disc members, generally indicated as 40, comprised of a disc 42 are mounted in spaced-apart relationship on each shaft 28 and 30 in interdigitating relationship between disc member 40 mounted on the shaft 28 with respect to the disc members 40 on the shaft 30 as more fully hereinafter described.

A disc 42 is formed with side surfaces 44 and 46 and an outer circularly-shaped outer surface 48, referring now to FIGS. 4–8. Each disc 42 of the disc member 40 is mounted on a respective shaft 28 and 30, such as by welding. Each disc 42 mounted on the shaft 28 is provided with a plurality of arcuately-shaped shoe members 50 (eight illustrated) peripherally mounted in abutting relationship about the outer end surface 48 of the disc 42, such as by nut and bolt assemblies 54. Each disc 42 mounted on the shaft 30 is provided with a plurality of arcuated-shaped shoe members 52 similarly mounted on the disc 42 as the disc members 40 on the shaft 28.

The arcuately-shaped shoe member 50 is formed of one piece construction and is generally U-shaped in cross-section, referring now to FIGS. 5 to 8, and is comprised of side leg portions 56 and 58 including inner radial surfaces 60, and an outer circularly-shaped outer wall portion 62 having an inner radial surface 64 defining a chamber 66 for positioning on the shoe member 50 on the disc 42. The shoe member 50 is preferably formed with a leading edge 66 and a trailing edge 68 at an angle from a perpendicular line from the inner radial surfaces 60 of each leg portion 56 and 58 to an outer radial surface 70 of the outer wall portion 62 thereby providing a form of interlocking relationship between adjacent shoe members 50 when mounted in the abutting relationship on the disc 42 of each disc member 40. It is understood that the leading edge 66 and trailing edge 68 may be in perpendicular relationship to the inner radial surface 60 and outer radial surface 70 of the shoe member 50.

From the outer surfaces 72 and 74 of the leg portions 56 and 58 of the shoe member 50, there is integrally-formed a plurality of laterally-extending, curvilinearly-shaped vanes 76 and 78, respectively, having a convex leading surface 80 in the direction of rotation contoured to accelerate a fluid being processed from the inner radial edges 60 of the shoe member 50 outwardly towards the inner surface of the tank members 12 and 14.

The outer radial surface 70 of the outer wall portion 62 of the shoe member 50 is formed with a plurality of turbulence inducers 82, preferably in the shape of a teardrop with an apex 84 directed towards the leading edge of each shoe member 50 to affect turbulent flow about the periphery of the disc member 50 with respect to the inner surface of the chamber portions 16 and 18 of the tank portions 12 and 14.

In one manner of operation, material in slurry form, such as drill cuttings from a wellbore, is introduced into the pulverizer assembly 10 through the inlet conduit 24 of the pulverizer assembly 10. Generally, such drill cuttings will contain particles of a size larger than about 50 mesh. Once inside the tanks 12 and 14, the particle material is broken up by continual particulate collisions, caused by the action of the counter-rotating shafts 28 and 30 and disc members 40 in opposing rotational relationship to cause the material to be forced by the vanes 76 and 78 of the shoe members concomitantly with the action produced by the depressions 82 in an overlapping, interdigitating manner, as hereinabove discussed. In this manner of operation, while the particulate matter in the slurry material may be undergoing continuous collision with other particulate matter within the slurry material, a prime collision area would be at the top of the pulverizer assembly 10 where disc members 40 would be inducing flow angularly, downwardly, such that fluid and particulate matter driven by shaft 28 and the discs 40 mounted thereon would angularly collide with fluid and particulate matter driven by shaft 30 and the discs mounted thereon in the upper portion of pulverizer 10 proximate the longitudinal intersection of tanks 12 and 14.

In another manner of operation, the shoe members 50 on discs 40 of one shaft member, either shaft member 28 or 30, would be reversed with shafts 28 and 30 then operating in the same rotational direction. This would induce a slurry flow of fluid and particulate matter which would induce the primary particulate collision in the vertical plane formed by the intersection of cylindrical tank portions 12 and 14.

In either one of the operational embodiments described above, the leading surface 80 of vane 76 and 78 would be convex. However, shafts 28 and 30 may be rotated such that the leading surface of vanes 76 and 78 would be the concave surface 79.

In the operational embodiments of the invention set forth above, a pair of 75 HP motors 34 are used to rotate the shafts 28 and 30 with horsepower being varied as a function of the size of the pulverizer assembly 10. Generally, the shafts 28 and 30 operate at the same rpm, generally in the range of 1400 to 1900 rpm.

The action of the vanes 76 and 78 of the shoe member 50 force the particulate material of the slurry to collide with and thereby break into smaller pieces, particularly as the process continues throughout the length of the tanks 12 and 14 until a slurry containing particles of reduced size is withdrawn via outlet conduit 26 for further treatment.

Generally, only one pass through the pulverizer assembly 10 is adequate to reduce the particulate material to a predetermined size.

While the present invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. A pulverizing assembly for producing finely ground material, comprising:

a tank member formed by interconnected cylindrical chambers in fluid communication and in overlapping relation along the length thereof, said tank member having a conduit for receiving material to be processed and a conduit for processed material discharge;

a shaft mounted for rotation in each cylindrical chamber and parallelly-disposed to one another;

means for rotating said shafts;

a plurality of disc members mounted in spaced-apart relationship on each shaft, each disc member comprised of a disc mounted on each shaft and having a plurality of arcuately-shaped shoe members mounted in abutting relationship about a periphery of said disc of said disc member, means on said shoe members for accelerating material to be processed within said tank member.

2. The pulverizing assembly as defined in claim 1 wherein said means for accelerating material to be processed are formed by side surfaces of said shoe member having outwardly-extending curvilinearly-shaped vanes, said vanes having a convexly-shaped leading surface in a direction of rotation of said shaft.

3. The pulverizing assembly as defined in claim 1 or 2 wherein an outer circumferential surface of said shoe member are formed with a plurality of turbulence inducers.

4. The pulverizing assembly as defined in claim 3 wherein said turbulence inducers are indentations in the shape of a teardrop.

5. The pulverizing assembly as defined in claim 4 wherein an apex of said teardrop is coincident to said leading edge of said curvilinearly-shaped vanes.

6. The pulverizing assembly in accordance with claim 1 wherein said disc members mounted on one said parallelly-disposed shaft being an interdigitating relationship to said disc members mounted on said other parallelly-disposed shaft.

7. The pulverizing assembly in accordance with claim 1 wherein said means for rotating said shafts comprises a power means for rotating one of said shafts in a clockwise direction and the other of said shafts in a counterclockwise direction at a speed to cause said particulate material to flow about the inner surfaces of said chambers in a manner to cause respective flows to contact each other in particle/particle contact to affect particle size reduction.

8. The pulverizing assembly in accordance with claim 1 wherein said means for rotating said shafts comprises a power means for rotating said shafts in the same direction at a speed to cause said particulate material to flow about the inner surfaces of said chambers in a manner to cause respective flows to contact each other in particle/particle contact to affect particle size reduction.

9. A shoe member for mounting on a disc member of a pulverizing assembly for producing finely ground material, said shoe member comprising an arcuately-shaped circumferential outer surface having parallel leg members depending from the edges thereof in spaced apart relationship defining a channel for slidably mounting in abutting relationship with identical shoe members about the periphery of a disc member wherein the outer side surfaces of said leg members are formed with outwardly extending curvilinearly-shaped vanes, said vanes having a convexly-shaped leading surface in a direction of rotation of said disc member.

10. The shoe member in accordance with claim 9 wherein said circumferential outer surface of said shoe member is formed with a plurality of turbulance inducers.

11. The shoe member in accordance with claim 10 wherein said turbulance inducers are indentations in the shape of a tear drop.

12. The shoe member in accordance with claim 11 wherein an apex of said tear drop is coincident to said leading edge of said curvilinear-shaped vanes.

* * * * *